US007432430B2

(12) United States Patent
Sasaki

(10) Patent No.: US 7,432,430 B2
(45) Date of Patent: Oct. 7, 2008

(54) MUSICAL INSTRUMENT, MUSIC DATA PRODUCER INCORPORATED THEREIN AND METHOD FOR EXACTLY DISCRIMINATING HAMMER MOTION

(75) Inventor: Tsutomu Sasaki, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 199 days.

(21) Appl. No.: 11/215,676

(22) Filed: Aug. 29, 2005

(65) Prior Publication Data

US 2006/0065103 A1 Mar. 30, 2006

(30) Foreign Application Priority Data

Sep. 16, 2004 (JP) ..... 2004-269992

(51) Int. Cl.
*G10G 3/04* (2006.01)
*G10H 3/06* (2006.01)
*G10H 3/22* (2006.01)

(52) U.S. Cl. ..... 84/462; 84/724

(58) Field of Classification Search ..... 84/741, 84/20, 22, 462, 724
See application file for complete search history.

(56) References Cited

U.S. PATENT DOCUMENTS 4,970,928 A * 11/1990 Tamaki ..... 84/21
5,583,310 A 12/1996 Sugiyama et al.
5,627,333 A 5/1997 Stahnke et al.
2001/0054346 A1 12/2001 Uehara
2005/0145104 A1 * 7/2005 Sasaki ..... 84/746

FOREIGN PATENT DOCUMENTS

EP 1 555 651 A 7/2005

* cited by examiner

*Primary Examiner*—Lincoln Donovan
*Assistant Examiner*—Andrew R Millikin
(74) *Attorney, Agent, or Firm*—Morrison & Foerster LLP

(57) ABSTRACT

In an automatic player piano, hammer sensors monitor associated hammers so as to report current positions on the hammer trajectories, and a data processor analyzes the hammer motion for producing pieces of music data representative of the performance on the acoustic piano; the aged deterioration is influential in the relative position between the hammers and the hammer sensors so that the data processor rectifies the relative position, the data processor determines the turning point at which the hammer changes the direction of motion, and compares the current value indicating the turning point with the previous value; if the difference is found, the data processor adds a value of deflection of strings to the current value so as to determine and memorizes the true value of the turning point; the data processor analyzes the hammer motion on the basis of the true value so that the music data are reliable.

17 Claims, 9 Drawing Sheets

TBL1

| | | |
|---|---|---|
| 1 | AD | TIME |
| 2 | AD | TIME |
| 3 | AD | TIME |
| ⋮ | ⋮ | ⋮ |
| 20 | AD | TIME |

Fig. 6 A

TBL2

| | VELOCITY | ACCELERATION |
|---|---|---|
| AD(−5),t(−5) | | |
| AD(−4),t(−4) | v(−4) | a(−4) |
| AD(−3),t(−3) | v(−3) | a(−3) |
| AD(−2),t(−2) | v(−2) | a(−2) |
| AD(−1),t(−1) | v(−1) | a(−1) |
| AD(0),t(0) | v(0) | a(0) |
| AD(1),t(1) | v(1) | a(1) |
| AD(2),t(2) | v(2) | a(2) |
| AD(3),t(3) | v(3) | a(3) |
| AD(4),t(4) | v(4) | a(4) |
| AD(5),t(5) | v(5) | |

Fig. 6 B

MUSICAL INSTRUMENT, MUSIC DATA PRODUCER INCORPORATED THEREIN AND METHOD FOR EXACTLY DISCRIMINATING HAMMER MOTION

FIELD OF THE INVENTION

This invention relates to a controlling technique for generating tones and, more particularly, to a keyboard musical instrument, a music data producer incorporated in the keyboard musical instrument, a method for exactly discriminating hammer motion and a computer program expressing the method.

DESCRIPTION OF THE RELATED ART

An automatic player piano is a typical example of the hybrid musical instrument. The automatic player piano is a combination of an acoustic piano and an electronic system, and a human pianist and an automatic player, which is implemented by the electronic system, perform pieces of music on the acoustic piano. While the human player is fingering on the keyboard, the depressed keys actuate the associated action units, which give rise to rotation of the hammers, and the strings are struck with the hammers at the end of the rotation. Then, the strings vibrate, and acoustic piano tones are produced through the vibrations of strings.

When a user instructs the automatic player to reenact the performance expressed by a set of music data codes, the automatic player starts to analyzes the music data codes, and sequentially give rise to the key motion and pedal motion without any fingering of the human player. While the black and white keys are traveling on respective reference trajectories, which the automatic player determines for the keys to be depressed on the basis of the music data codes, the key motion and/or hammer motion is monitored by key sensors and/or hammer sensors, and the automatic player forces the black and white keys to travel on the reference trajectories through the servo control loop.

The electronic system further serves as a recorder and/or electronic keyboard in several models of the automatic player piano. The recorder analyzes the key motion and/or hammer motion in an original performance on the acoustic piano, and produces music data codes representative of the original performance. The automatic player may reenact the performance expressed by the music data codes.

When a user instructs the electronic system to produce electronic tones instead of the acoustic piano tones, the music data codes, which are originated from the performance by the human pianist or loaded from an external data source, are supplied to the electronic tone generator, and an audio signal is produced from pieces of waveform data so as to be converted to the electronic tones. In case where the music data codes are originated from the performance on the acoustic piano, the key sensors, pedal sensors and/or hammer sensors reports the pedal motion, key motion and/or hammer motion to the controller, and the controller produces the music data codes through the analysis on these pieces of music data. Thus, the key sensors, hammer sensors and pedal sensors are the important system components of the electronic system incorporated in the hybrid musical instrument.

Since the key motion and hammer motion are not simple, it is desirable that the key sensors and hammer sensors have monitoring ranges overlapped with the key trajectories and hammer trajectories. A typical example of the hammer sensor with the wide monitoring range is disclosed in Japanese Patent Application laid-open No. 2001-175262. The prior art hammer sensor continuously monitors the hammer shank between the rest position and the rebound on the associated string. The prior art hammer sensor informs the controller of the current hammer position on the hammer trajectory, and makes it possible to calculate the hammer velocity and acceleration. Although the position, velocity and acceleration are different sorts of physical quantity, any one of those sorts of physical quantity expresses the hammer motion.

The controller further analyzes the physical quantity so as to determine unique points on the hammer trajectory and another sort of physical quantity. The Japanese Patent Application laid-open teaches us that the controller determines the followings.

1. Time at which the hammer starts its motion, i.e., the starting time.
2. Time at which the hammer is brought into collision with the associated string, i.e., the impact time.
3. Hammer velocity immediately before the strike on the associated string, i.e., final hammer velocity.
4. Time at which the associated black or white key starts the key motion, i.e., the depressed time.
5. Time at which the back check receives the hammers after the rebound on the string, i.e., the back check time.
6. Time at which the hammer leaves the back check, i.e., the separating time.
7. Hammer velocity after the separation from the back check, i.e., the return velocity.
8. Time at which the damper returns onto the strings, i.e., the decay time.
9. Time at which the hammer is terminated at the end of the hammer trajectory, i.e., the end time.
10. Time at which the depressed key is released, i.e., the release time. Thus, the controller acquires the various sorts of music data through the analysis on the pieces of hammer data expressing the hammer motion.

In the analysis, the controller compares the current hammer position with thresholds to see where the hammer is found, and determines a trajectory on which the hammer has traveled. The controller presumes the associated key motion, and categorizes the key motion in a certain style of rendition. The thresholds are initially fixed to certain values. Since the prior art hammer sensors disclosed in the Japanese Patent Application laid-open are calibrated against the aged deterioration of the light emitting elements, the certain values are varied together with the characteristics of the hammer sensors. However, the user feels the tones produced in the automatic playing deviated from those produced in the original performance. The deviation takes place after a long time, and is hardly solved through the prior art calibration.

SUMMARY OF THE INVENTION

It is therefore an important object of the present invention to provide a musical instrument, which exactly discriminates motion of links such as, for example, hammers.

It is also an important object of the present invention to provide an automatic player, which is to be incorporated in the musical instrument.

It is another important object of the present invention to provide a method for exactly discriminating the motion of the links.

It is yet another important object of the present invention to provide a computer program, which exactly expresses the method.

The present inventor contemplated the problem, and noticed that the aged deterioration had been influential in the linkwork. For example, some component parts of action units had been worn out, and made the action units hardly cooperate with the hammers as those in the early times. Thus, the mechanical component parts were not free from the aged deterioration as similar to the electric component parts. However, the thresholds were determined on the assumption that the action units and hammers would repeat ideal motion. As a result, the thresholds gradually have not suited for the analysis on the hammer motion. The present inventor concluded that the thresholds were to be rectified against the aged deterioration.

In accordance with one aspect of the present invention, there is provided a musical instrument for producing tones comprising plural tone generating linkworks selectively actuated for specifying the tones to be produced, each of the plural tone generating linkworks having a component part and another component part, and a music data producer including plural sensors monitoring the component parts and producing signals representative of plural series of pieces of motion data expressing motion of the associated component parts on respective trajectories, a data processing unit connected to the plural sensors and having an analyzer analyzing the plural series of pieces of motion data so as to determine current values indicative of unique points on the trajectories, a judge determining whether or not the component parts reach the unique point at previous values and a rectifier determining true values expressing the unique points on the basis of the current values when the judge makes the negative decision and storing the true values as the previous values in a memory.

In accordance with another aspect of the present invention, there is provided a music data producer comprising plural sensors monitoring component parts of a musical instrument actuated for specifying tones to be produced, and producing signals representative of plural series of pieces of motion data expressing motion of the associated component parts on respective trajectories, and a data processing unit connected to the plural sensors and having an analyzer analyzing the plural series of pieces of motion data so as to determine current values indicative of unique points on the trajectories, a judge determining whether or not the component parts reach the unique point at previous values and a rectifier determining true values expressing the unique points on the basis of the current values when the judge makes the negative decision and storing the true values as the previous values in a memory.

In accordance with yet another aspect of the present invention, there is provided a method for rectifying a value indicative of a unique point on a trajectory of a component part incorporated in a musical instrument comprising the steps of a) accumulating pieces of motion data expressing motion of the component part, b) finding a unique point on the trajectory, c) determining a current value indicative of the unique point, d) judging whether or not the unique point is expressed by a previous value, e) determining a true value indicative of the unique point on the basis of the current value when the answer at step d) is given negative, f) storing the true value as the previous value, and g) repeating the steps a) to d) when the answer at step d) is given affirmative.

BRIEF DESCRIPTION OF THE DRAWINGS

The features and advantages of the musical instrument, automatic player and method will be more clearly understood from the following description taken in conjunction with the accompanying drawings, in which FIGS. 6A and 6B are views showing tables for presuming hammer state.

DESCRIPTION OF THE PREFERRED EMBODIMENTS

Figure 1:
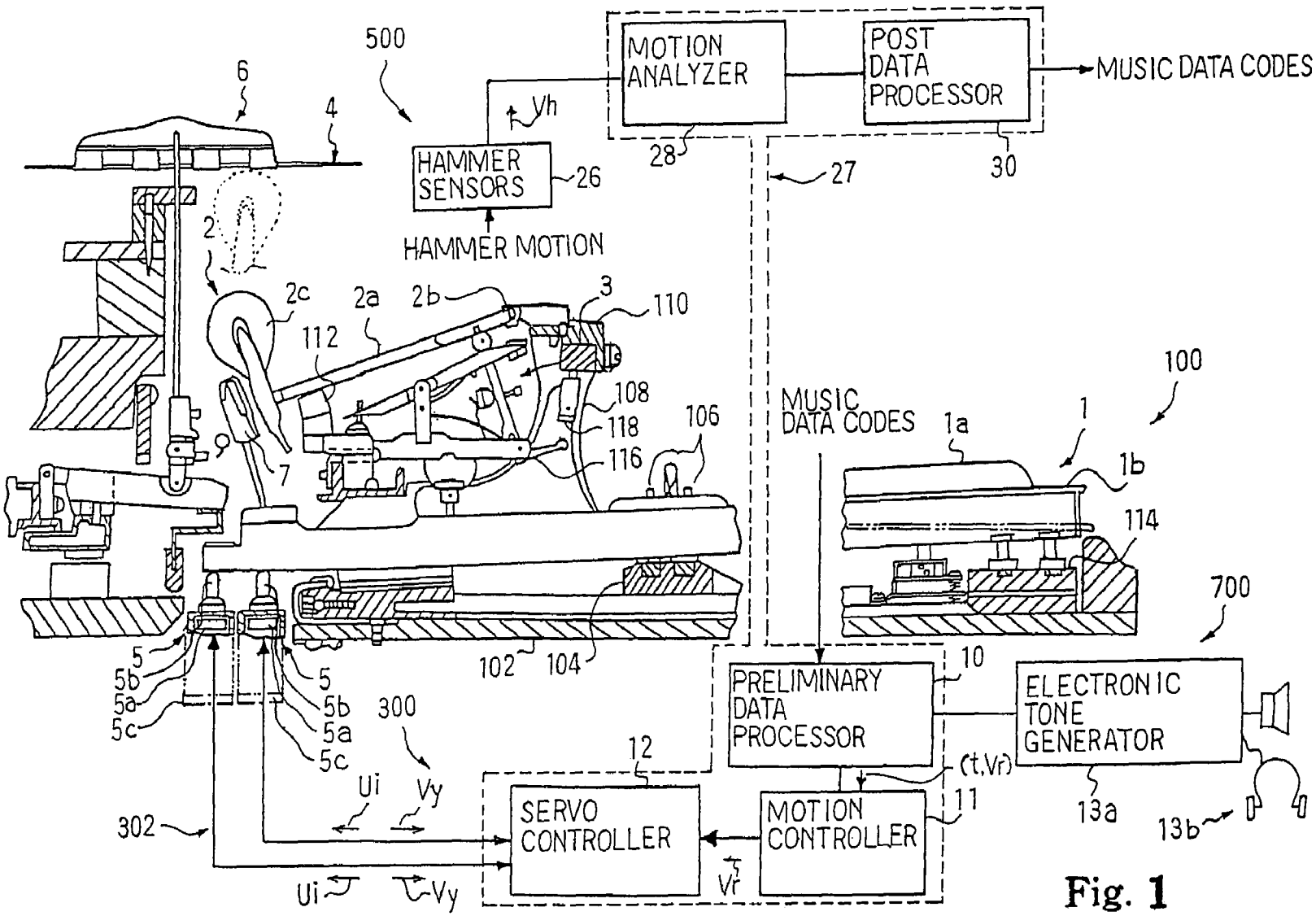
FIG. 1 is a side view showing the structure of an automatic player piano according to the present invention.

A musical instrument embodying the present invention largely comprises plural tone generating linkworks and a music data producer. A player, who is either human being or electronic player such as, for example, an automatic player, selectively actuates the plural tone generating linkworks for specifying tones to be produced. When the player actuates the plural tone generating linkworks, component parts of each tone generating linkwork are sequentially moved on respective trajectories, and the tones are produced at the end of the motion. In case where an acoustic piano is incorporated in the musical instrument, plural series of black/white keys, action units, hammers and strings serve as the plural tone generating linkworks, by way of example, and the player selectively drives the hammers to rotate by depressing and releasing the associated black/white keys so that the strings are struck with the hammers at the end of the rotation. The black/white keys pitch up and down, and give rise to complicated rotation of the associated action units. The hammers are driven for rotation, and the strings vibrate for producing the tones. Thus, the component parts are moved on their trajectories.

The music data producer includes plural sensors and a data processing unit. The plural sensors monitor certain component parts of the plural tone generating linkworks, and produces signals representative of plural series of motion data. The plural series of motion data express the motion of the associated component parts on the trajectories. Since the tones are produced at the end of the motion on the trajectories of the component parts, the motion of the component parts is influential in attributes of the tones. For this reason, the data processing unit needs exactly to grasp the motion of the trajectories. However, the relative position between the component parts and the sensors is varied due to the aged deterioration of the component parts of the tone generating linkworks. The undesirable variation in the relative position makes it difficult exactly to grasp the motion of the component parts.

In order to rectify the sensors and component parts in the optimum relative position, the data processing unit includes an analyzer, a judge and a rectifier. The analyzer analyzes the plural series of pieces of motion data, and determines current values indicative of unique points on said trajectories through the analysis. The unique points make the component parts correlate with the sensors, and the current values, which are indicative of the unique points, are varied when the component parts and sensors are deviated from the optimum relative position. The current values are transferred from the analyzer to the judge, and the judge compares the current values with previous values, which were correctly indicative of the unique points, to see whether or not the relative value is unchanged. If the component parts reach the unique points at the previous value, i.e., the current values are equal to the previous values, the answer is given affirmative. However, when the component parts do not reach the unique points at the previous values, the answer is given negative, and the rectifier determines true values, which express the unique points on the basis of the current values. The rectifier stores the true values as the previous values, and waits for the next negative answer.

In case where the component parts cooperate with other component parts, the component parts may give rise to deflection of the other component parts. For example, the hammers give rise to the deflection of the strings at the collision with the strings. The deflection permits the component parts to run over the unique points. For this reason, the rectifier adds values equivalent to the amount of deflection to the current values. Thus, the rectifier determines the true values precisely indicative of the unique points, and makes the data processing unit exactly determine the attributes of tones to be produced.

In the following description, term "front" is indicative of a position closer to a player, who is fingering a piece of music, than a position modified with term "rear". Term "fore-and-aft" is indicative of a direction parallel to a line drawn between a front position and a corresponding rear position, and "lateral direction" crosses the fore-and-aft direction at right angle.

First Embodiment

Referring to FIG. 1 of the drawings, an automatic player piano embodying the present invention largely comprises an acoustic piano 100 and an electric system, which serves as an automatic playing system 300, a recording system 500 and an electronic tone generating system 700. The automatic playing system 300, recording system 500 and electronic tone generating system 700 are installed in the acoustic piano 100, and are selectively activated depending upon user's instructions. While a player is fingering a piece of music on the acoustic piano 100 without any instruction for recording, playback and performance through electronic tones, the acoustic piano 100 behaves as similar to a standard acoustic piano, and generates the piano tones at the pitch specified through the fingering.

When the player wishes to record his or her performance on the acoustic piano 100, the player gives the instruction for the recording to the electric system, and the recording system 500 gets ready to record the performance. In other words, the recording system 500 is activated. While the player is fingering a music passage on the acoustic piano 100, the recording system 500 produces music data codes representative of the performance on the acoustic piano 100, and the set of music data codes are stored in a suitable memory forming a part of the electric system or remote from the automatic player piano. Thus, the performance is memorized as the set of music data codes.

A user is assumed to wish to reproduce the performance. The user instructs the electric system to reproduce the acoustic tones. Then, the automatic playing system 300 gets ready for the playback. The automatic playing system 300 fingers the piece of music on the acoustic piano 100, and reenacts the performance without any fingering of the human player.

A user may wish to hear electronic tones along a music passage. The user instructs the electronic tone generating system 700 to process the set of music data codes. Then, the electronic tone generating system 700 starts sequentially to process the music data codes so as to produce the electronic tones along the music passage.

The acoustic piano 100, automatic playing system 300, recording system 500 and electronic tone generating system 700 are hereinafter described in detail.

Acoustic Piano

In this instance, the acoustic piano 100 is a grand piano. The acoustic piano 100 includes a keyboard 1, hammers 2, action units 3, strings 4 and dampers 6. A key bed 102 forms a part of a piano cabinet, and the keyboard 1 is mounted on the front portion of the key bed 102. The keyboard 1 is linked with the action units 3 and dampers 6, and a pianist selectively actuates the action units 3 and dampers 6 through the keyboard 1. The dampers 6, which have been selectively actuated through the keyboard 1, are spaced from the associated strings 4 so that the strings 4 get ready to vibrate. On the other hand, the action units 3, which have been selectively actuated through the keyboard 1, give rise to free rotation of the associated hammers 2, and the hammers 2 strike the associated strings 4 at the end of the free rotation. Then, the strings 4 vibrate, and the acoustic tones are produced through the vibrations of the strings 4. When the hammers 2 are brought into collision with the strings 4, the hammers 2 rebound on the strings 4, and are dropped from the strings 4.

The keyboard 1 includes plural black keys 1*a*, plural white keys 1*b* and a balance rail 104. The black keys 1*a* and white keys 1*b* are laid on the well-known pattern, and are movably supported on the balance rail 104 by means of balance key pins 106.

Action brackets 108 are laterally spaced from one another. A shank flange rail 110 laterally extends over the black keys 1*a* and white keys 1*b*, and is secured to the upper ends of the action brackets 108. The hammers 2 include respective hammer shanks 2*a*, and the hammer shanks 2*a* are rotatably connected to the shank flange rail 110 by means of pins 2*b*. The hammers 2 further include respective hammer heads 2*c*, which are respectively fixed to the leading ends of the hammer shanks 2*a*. Although back checks 7 upwardly project from the rear end potions of the black and white keys 1*a*/1*b*, the back checks 7 form parts of the action units 3, and the make the hammer heads 2*c* softly land thereon after the rebound on the strings 4. In other words, the back checks 7 prevent the hammers 2 from chattering on hammer shank stop felts 112.

While any force is not exerted on the black/white keys 1*a*/1*b*, the hammers 2 and action units 3 exert the force due to the self-weight on the rear portions of the black/white keys 1*a*/1*b*, and the front portions of the black/white keys 1*a*/1*b* are spaced from the front rail 114 as drawn by real lines. The key position indicated by the real lines is "rest position", and the keystroke is zero at the rest position.

When a pianist depresses the front portions of the black/white keys 1*a*/1*b*, the front portions are sunk against the self-weight of the action units/hammers 3/2. The front portions finally reach "end positions" indicated by dots-and-dash lines. The end positions are spaced from the rest positions along the key trajectories by a predetermined distance.

While the pianist is depressing the front portions of the black and white keys 1*a*/1*b*, the rear portions of the black and white keys 1*a*/1*b* are raised, and give rise to the rotation of the associated action units 3. A jack 116 is brought into contact with a regulating button 118, and escapes from the hammers 2*a*. The escape gives rise to the free rotation of the hammer 2 so that the hammer head 2*c* advances to the string 4. The depressed key 1*a*/1*b* further causes the dampers 6 to be spaced from the string 4 so that the string 4 gets ready for the vibrations as described hereinbefore. The hammer 2 is brought into collision with the string 4 at the end of the free rotation for producing the acoustic tones as drawn by dot lines. The hammer 3 rebounds on the strings 4, and is received by the back check 7.

When the pianist releases the depressed black and white keys 1*a*/1*b*, the self-weight of the action unit/hammer 3/2 gives rise to the rotation of the black and white keys 1*a*/1*b* in the counter direction, and the action unit/hammer 3/2 return to the respective rest positions. The dampers 6 are brought into contact with the associated strings 4 on the way to the rest position so that the acoustic tones are decayed. In this instance, the hammers 2 travel on the hammer trajectories between the rest positions and the end of free rotation, and the end of free rotation is spaced from the rest position by 48 millimeters. The position, which is spaced from the rest position by 48 millimeters, is referred to as an "end position". The hammer head 2*c* drawn by the dot lines is indicative of the end position.

Electronic System

Figure 2:
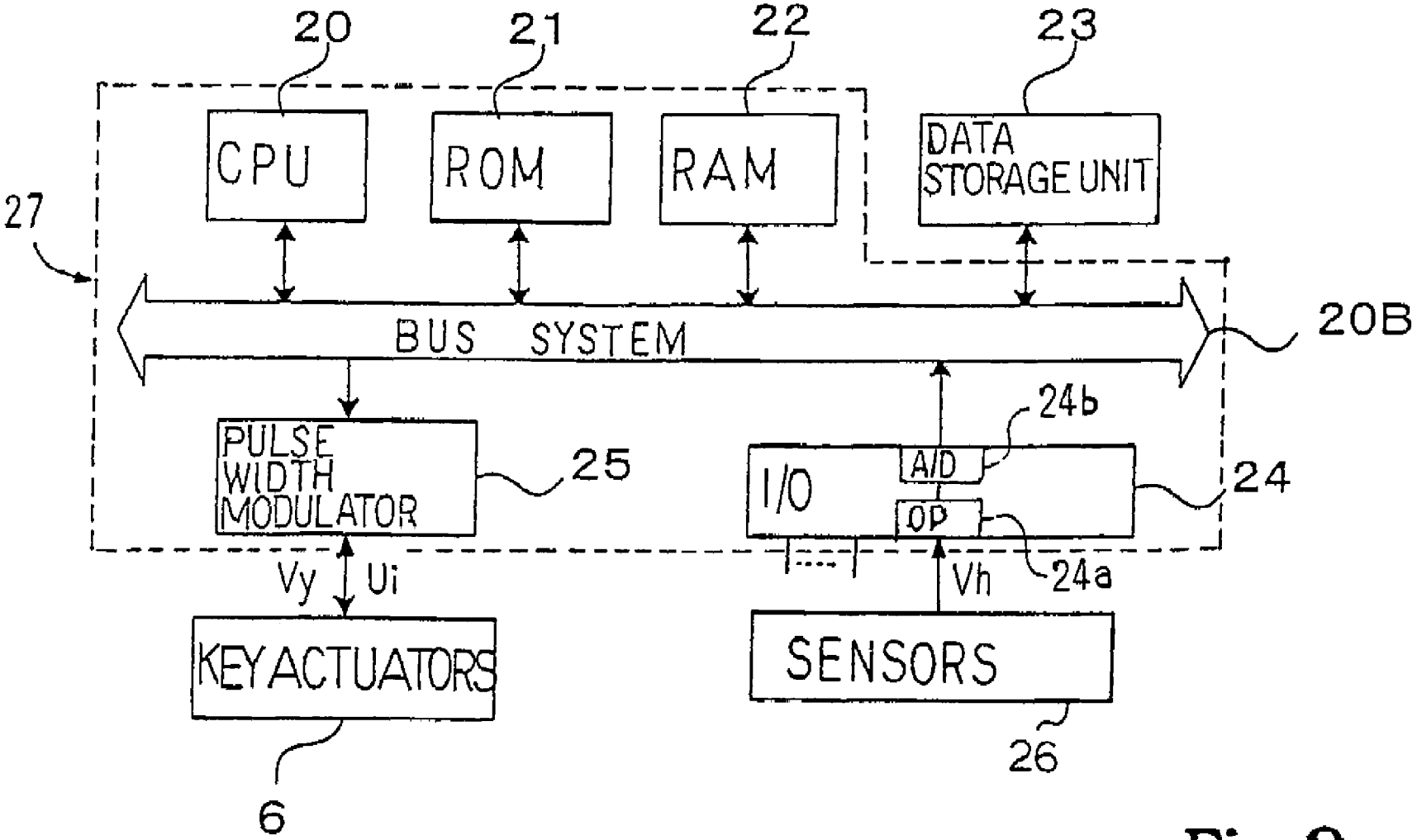
FIG. 2 is a block diagram showing the system configuration of a data processing unit incorporated in the automatic player piano.

Description is hereinafter made on the electronic system, which serves as the automatic playing system 300, recording system 500 and electronic tone generating system 700 with concurrent reference to FIGS. 1 and 2.

The automatic playing system 300 includes an array of solenoid-operated key actuators 5, a manipulating panel (not shown), a data storage unit 23 (see FIG. 2) and a data processing unit 27. The recording system 500 includes hammer sensors 26, and further includes the manipulating panel (not shown), data storage unit 23 and data processing unit 27. The electronic tone generating system 700 includes the data storage unit 23, data processing unit 27, an electronic tone generator 13*a* and a sound system 13*b*. Thus, the data processing unit 27 and manipulating panel (not shown) are shared among the automatic playing system 300, the recording system 500 and electronic tone generating system 700.

The key bed 102 is formed with a slot under the rear portion of the black and white keys 1*a*/1*b*, and the slot laterally extends. The array of the solenoid-operated key actuators 5 is supported by the key bed 102 in such a manner as to project through the slot. The solenoid-operated key actuators 5 are laterally arranged in a staggered fashion, and are associated with the black and white keys 1*a*/1*b*, respectively. A solenoid 5*a*, a plunger 5*b*, return sprint (not shown) and a built-in plunger sensor 5*c* are assembled into each solenoid-operated key actuator 5 together with a yoke, which is shared with the other solenoid-operated key actuators 5. While the solenoid 5*a* is standing idle, the tip of the plunger 5*b* is in the proximity of the lower surface of the rear portion of the associated black or white key 1*a*/1*b*. When the solenoid 5*a* is energized with a driving signal Ui, magnetic field is created, and the force is exerted on the plunger 5*b*. Then, the plunger 5*b* upwardly projects from the solenoid 5*a*, and upwardly pushes the rear portion of the black or white key 1*a*/1*b*. The plunger sensor 5*c* monitors the plunger 5*b*, and produces a plunger position signal Vy representative of the current plunger position. The solenoid 5*a*, built-in plunger sensor 5*c* and a servo controller 12 form in combination a servo control loop 302, and the plunger motion and, accordingly, key motion is controlled through the servo control loop 302.

The hammer sensors 26 are respective associated with the hammers 2, and are categorized in an optical position transducer. The hammer sensors 26 have a monitoring range overlapped with the hammer trajectories so as to convert the current physical quantity such as current hammer position into hammer position signals Vh.

Each of the hammer sensors 26 includes a light radiating sensor head, a light receiving sensor head, a light emitting element, a light detecting element and optical fibers connected between the light emitting element/light detecting elements and the light radiating sensor head/light receiving sensor head. The light radiating sensor heads form light radiating sensor head groups, and the light receiving sensor heads also form light receiving sensor head groups. Each of the light radiating sensor head groups is coupled to one of the light emitting elements through a bundle of optical fibers, and the light receiving sensor heads, each of which is selected from one of the light receiving sensor head groups, are respectively coupled to the light detecting elements through the optical fibers, each of which are selected from bundles of optical fibers.

A time frame is divided into plural time slots, and the plural time slots are respectively assigned to the light emitting elements. The time frame is repeated, and each time slot takes place at regular intervals. For this reason, the light emitting elements are sequentially energized in the time slots assigned thereto, and the light is supplied from the light emitting element just energized to the associated bundle of optical fibers.

The light is concurrently supplied from each light emitting element to the associated light radiating sensor head group through the bundle of optical fibers, and is radiated from the light radiating sensor heads to the light receiving sensor heads across the hammer trajectories of the associated hammers 2. The light, which is concurrently output from the light radiating sensor heads, is incident on the light receiving sensor heads, each of which is selected from one of the light receiving sensor head groups, and is transferred through the optical fibers to the light detecting elements. The light detecting elements convert the incident light to photo current, the amount of which is proportional to the amount of incident light.

In this instance, twelve light emitting elements and eight light detecting elements are provided for the eighty-eight black and white keys 1*a*/1*b*. The control sequence for the hammer sensors 26 is, by way of example, disclosed in Japanese Patent Application laid-open No. Hei 9-54584.

The amount of incident light is varied together with the current hammer position on the hammer trajectory for the associated hammer 2. For this reason, the amount of photo current is also varied together with the current hammer position, and the photo current flows out from each light detecting element as the hammer position signals Vh.

The data processing unit 27 includes a central processing unit 20, which is abbreviated as "CPU", a read only memory 21, which is abbreviated as "ROM", a random access memory 22, which is abbreviated as "RAM", a bus system 20B, an interface 24, which is abbreviated as "I/O" and a pulse width modulator 25. These system components 20, 21, 22, 24 and 25 are connected to the bus system 20B, and the data storage unit 23 is further connected to the bus system 20B. Address codes, instruction codes, control data codes and music data codes are selectively propagated from particular system components to other system components through the bus system 20B. Though not shown in FIG. 2, a clock generator and a frequency divider are further incorporated in the data processing unit 27, and a system clock signal and a tempo clock signal make the system components synchronized with one another and various timer interruptions take place.

The central processing unit 20 is the origin of the data processing capability. The instruction codes, which are representative of a main routine program and subroutine programs, and data/parameter tables, are stored in the read only memory 21. The computer programs run on the central processing unit 20 so as to accomplish jobs selectively assigned to a preliminary data processor 10, a motion controller 11, a servo controller 12, a motion analyzer 28 and a post data processor 30. A subroutine program running on the central processing unit 20 makes the hammer sensors 26 calibrated against aged deterioration on the mechanical component parts as will be hereinlater described in detail.

The read only memory 21 includes electrically erasable and programmable memory devices so that pieces of data are rewritable. The random access memory 22 offers a temporary data storage, and serves as a working memory, which is hereinafter labeled with the same reference numeral "22".

The data storage unit 23 offers a large amount of data holding capacity to the automatic playing system 300, recording systems 500 and electronic tone generating system 700. The music data codes are stored in the data storage unit 23 for the playback. In this instance, the data storage unit 23 is implemented by a hard disk driver. A flexible disk driver or floppy disk (trademark) driver, a compact disk driver such as, for example, a CD-ROM driver, a magnetic-optical disk driver, a ZIP disk driver, a DVD (Digital Versatile Disk) driver and a semiconductor memory board are available for the systems 300/500/700.

The hammer sensors 26 and manipulating panel (not shown) are connected to the interface 24, and the pulse width modulator 25 distributes the driving signal Ui to the solenoid-operated key actuators 5. The interface 24 contains plural operational amplifiers 24*a* and plural analog-to-digital converters 24*b*. Although sample-and-hold circuits are respectively connected to the plural analog-to-digital converters 24*b*, the sample-and-hold circuits are not shown in the drawings for the sake of simplicity. The light detecting elements are selectively connected to the operational amplifiers 24*a*, and the hammer position signals Vh are amplified through the operational amplifiers 24*a*. The operational amplifiers 24*a* are respectively connected through the sample-and-hold circuits (not shown) to the analog-to-digital converters 24*b* so that the discrete values on the analog hammer position signals are periodically converted to binary codes, which form digital hammer position signals. The system clock signal periodically gives rise to a timer interruption for the central processing unit 20 so that the central processing unit 20 periodically fetches the pieces of hammer data representative of the current hammer positions from the interface 24. The pieces of hammer data are transferred through the bus system 20B to the random access memory 22, and are temporarily stored therein. In this instance, the binary values of the digital hammer position signals are fallen within the range from zero to 1023

The pulse width modulator 25 is responsive to a control signal representative of a target mount of mean current or a target value of duty ratio so as to adjust the driving signals Ui to the target mean current or target duty ratio. The driving signals Ui are selectively distributed to the solenoid-operated key actuators 5. The magnetic field is created in the presence of the driving signal Ui so that it is possible to control the force exerted on the plungers 5*b* and, accordingly, on the black/white keys 1*a*/1*b* with the control signals.

The data processing unit 27 may further include a communication interface, to which music data codes are supplied from a remote data source through a public communication network. However, these system components merely indirectly concern the gist of the present invention, and no further description is incorporated for the sake of simplicity.

The function of the data processing unit 27, which forms a part of the automatic playing system 300, is broken down into the preliminary data processor 10, motion controller 11 and servo controller 12. In other words, the preliminary data processor 10, motion controller 11 and servo controller 12 are implemented by the subroutine programs running on the central processing unit 20.

A set of music data codes representative of a performance to be reenacted is loaded to the preliminary data processor 10. The set of music data was, by way of example, memorized in the data storage unit 23. Otherwise, the set of music data codes is supplied from an external data source through a public communication network and the communication interface (not shown) to the working memory 22.

The preliminary data processor 10 sequentially analyzes the music data codes, and determines the piano tones to be reproduced and timing at which the piano tones are reproduced and decayed. The piano tones to be produced are expressed by the key numbers Kni where i ranges from 1 to 88. The preliminary data processor 10 determines a reference key trajectory for the black/white keys 1*a*/1*b*, and further determines a series of values of target key velocity (t, Vr) on the reference key velocity. The target key velocity Vr is varied together with time t, and the target key velocity Vr expresses target key motion at time t together with another physical quantity such as, for example, the target key position. In case where the solenoid-operated key actuators 5 are expected to give rise to uniform motion, the target key velocity Vr is constant. The servo control loop 302 makes the plunger 5*b* and, accordingly, black 1*a*/1*b* catch up the target plunger velocity and target key velocity Vr.

There is a unique point on the reference key trajectory, and the unique point is called as a "reference point". If the black/white key 1*a*/1*b* passes the reference point at a target key velocity Vr, the black/white key 1*a*/1*b* gives rise to the hammer motion, which results in the strike on the string 4 at a target value of the final hammer velocity. Since the final hammer velocity is proportional to the loudness of the acoustic piano tone, the black/white key 1*a*/1*b*, which passes the reference key point at the target key velocity Vr, makes the string 4 to produce the acoustic tone at the target loudness expressed by the music data code.

The preliminary data processor 10 supplies a control data signal representative of the target key velocity (t, Vr) to the motion controller 11. The motion controller 11 checks the internal clock for the lapse of time. When the time t comes, the motion controller 11 supplies a control data signal representative of the current value of the target key velocity Vr to the servo controller 12. Thus, the motion controller 11 periodically informs the servo controller 12 of the series of values of target key velocity Vr.

The built-in plunger sensor 5*c* supplies the plunger position signal Vy representative of the current key position to the servo controller 12. The servo-controller 12 determines a current key velocity on the basis of a predetermined number of values of current key position. The current key velocity and current key position expresses current key motion. The servo-controller 12 compares the current key motion with the target key motion to see whether or not the black/white key 1*a*/1*b* surely travels on the reference key trajectory. If the difference takes place, the servo-controller 12 varies the mean current or duty ratio of the driving signal Ui, and supplies the driving signal Ui to the solenoid 5*a*. However, when the servo controller 12 does not find any difference between the current key motion and the target key motion, the servo controller 12 keeps the mean current or duty ratio at the previous value. Thus, the servo control loop 302 forces the black and white keys 1*a*/1*b* to pass the reference points at the target key velocity. This results in the tones at the target loudness.

The function of the data processing unit 27, which forms a part of the recording system 500, is broken down into the motion analyzer 28 and post data processor 30. The motion analyzer 28 and post data processor 30 are also implemented by another subroutine program running on the central processing unit 20.

The hammer sensors 26 supply the analog hammer position signals Vh, which represent current hammer positions of the associated hammers 2, to the motion analyzer 28, and the motion analyzer 28 periodically fetches the discrete values AD represented by the digital hammer position signals. The motion analyzer 28 determines pieces of hammer data such as the final hammer velocity and impact time and so forth which are required for pieces of music data codes in the formats defined in the MIDI (Musical Instrument Digital Interface) protocols.

The post data processor 30 presumes pieces of key data such as the key number Kni, and determines the pieces of music data on the basis of the pieces of hammer data, normalizes the pieces of music data, and produces the music data codes defined in the MIDI protocols. Duration data codes, each of which expresses the lapse of time between the continuous events, are inserted into the series of event data codes. The downward key motion for producing the piano tones is called as a "note-on event", and the note-on event is expressed by a note-on music data code. The key number Kni and a value of velocity, which expresses the loudness of the tone to be produced, are stored in the note-on music data code. On the other hand, the upward key motion for decaying the piano tones is called as a "note-off event", and the note-off event is expressed by a note-off music data code. A set of music data codes, which expresses the performance on the acoustic piano 100, is supplied to the data storage unit 23, and is stored therein. Otherwise, the music data codes are supplied from the communication interface (not shown) through the public network to an external data storage or another musical instrument in a real time fashion.

The electronic tone generating system 700 includes the preliminary data processor 10, an electronic tone generator 13*a* and a sound system 13*b*. The preliminary data processor 10 measures the lapse of time. When the time, at which the tone is to be produced or to be decayed, comes, the preliminary data processor 10 supplies the note-on data codes or note-off data codes to the electronic tone generator 13*a*. Pieces of waveform data are read out from a waveform memory, which forms a part of the electronic tone generator 13*a*, and form a digital audio signal representative of the electronic tones to be produced. The digital audio signal is supplied from the electronic tone generator 13*a* to the sound system 13*b*. The digital audio signal is converted to an analog audio signal, and the analog audio signal is equalized and amplified in the sound system 13*b*. Thereafter, the analog audio signal is converted to the electronic tones through loud speakers and/or a headphone.

The behavior of the automatic player piano is briefly described. Assuming now that a pianist instructs the recording system 500 to record his or her performance through the manipulating panel (not shown), the recording system 500 gets ready to record the performance on the acoustic piano 100. While the pianist is fingering on the keyboard 1, the hammer sensors 26 continuously report the current hammer positions of the associated hammers 2 to the interface 24 through the analog hammer position signals Vh. The analog hammer position signals Vh are amplified and sampled for the analog-to-digital conversion. The discrete values AD of the digital hammer position signals are varied between zero and 1023, and are transferred to the motion analyzer 28. A series of discrete values AD is accumulated in the working memory 22 for each of the black and white keys 1*a*/1*b*, and expresses a locus of the associated hammer 2. The motion analyzer 28 analyzes the series of discrete values AD or the locus of associated hammer 2 so as to extract the pieces of hammer data. The pieces of hammer data are supplied to the post data processor 30, and the post data processor 30 determines the pieces of music data to be required for producing the music data codes. Thus, the motion analyzer 28 cooperates with the post data processor 30, and accumulates the music data codes in the working memory 22. Upon completion of the performance, the post data processor 30 memorizes the set of music data codes expressing the performance in a suitable data file such as, for example, a standard MIDI file, and transfers the data file to the data storage unit 23 or an external destination through the public communication network.

A user is assumed to request the automatic playing system 300 to reenact the performance through the manipulating panel (not shown). The set of music data codes is loaded to the working memory 22, and the automatic playing system 300 gets ready for the performance.

The preliminary data processor 10 starts to measure the lapse of time, and compares the lapse of time with the time period expressed in the duration data code. When the preliminary data processor 10 decides that the depressed time has come, the preliminary data processor 10 determines the reference trajectory for a black/white key 1*a*/1*b* to be depressed and the series of values of target key velocity (t, Vr). The series of values of target key velocity (t, Vr) is transferred to the motion controller 11, and each value of target key velocity Vr is periodically supplied from the motion controller 11 to the servo controller 12. The servo controller 12 determines the current key motion on the basis of the plunger position signal Vy, and decides the mean current or duty ratio on the basis of the difference between the current key motion and the target key motion. The driving signal Ui is adjusted to the target value of the mean current or target value of duty ratio, and is supplied from the servo controller 12 to the solenoid 5*a* of the solenoid-operated key actuator 5 associated with the black/white key 1*a*/1*b* to be depressed. Thus, the mean current or duty ratio is periodically regulated to the target value so as to force the plunger 5*b* and associated black/white key 1*a*/1*b* to travel on the reference key trajectory. The black/white key 1*a*/1*b* actuates the associated key action unit 3, and makes the jack 116 escape from the associated hammer 2. The hammer 2 starts the free rotation at the escape, and is brought into collision with the associated string 4 at the end of the free rotation. The hammer 2 rebounds on the string 4, and is dropped onto the hammer shank stop felt 112. The back check 7 brakes the hammer 2, and makes the hammer 2 softly landed on the hammer shank stop felt 112.

When the preliminary data processor 10 finds the note-off event code for the back/white key 1*a*/1*b*, the preliminary data processor 10 determines a key trajectory toward the rest position, i.e., a reference backward key trajectory and a series of values of target released key velocity. The preliminary data processor 10 informs the motion controller 111 of the target released key velocity. The motion controller 11 periodically informs the servo controller 12 of the value of target key velocity, and requests the servo controller 12 to force the black/white key 1*a*/1*b* to travel on the reference backward key trajectory. While the plunger 5*b* is being retracted into the solenoid 5*a*, the servo controller 12 compares the current key motion with the target key motion to see whether or not the black/white key 1*a*/1*b* surely travels on the reference backward key trajectory, and the action unit 3 and hammer 2 return toward the rest positions. The damper 6 is brought into contact with the vibrating string 4 at the decay time, and the acoustic piano tone is decayed.

While the automatic playing system 300 is reenacting the performance, the above-described control sequence is repeated for the black and white keys 1*a*/1*b* which were depressed and released in the original performance, and the acoustic piano tones are produced along the music passage.

The user is assumed to produce the electronic tones along a music passage. The set of music data codes is also loaded to the working memory 22, and preliminary data processor 10 starts to measure the lapse of time. The preliminary data processor 10 periodically checks the internal clock to see whether or not the time to produce the electronic tone comes. While the answer is negative, the preliminary data processor 10 repeats the check. With the positive answer, the preliminary data processor 10 transfers the note-on event code to the electronic tone generator 13*a*, and makes the sound system 13*b* radiate the electronic tone. The preliminary data processor 10 repeats the above-described jobs until the end of the music passage so that the electronic tones are sequentially produced along the music passage.

Rectification on Hammer Sensors

The manufacturer prepares pieces of basic data for calibration against aged deterioration on the light emitting elements, and stores the basic data in the electrically erasable and programmable read only memory device, which forms a part of the read only memory 21, before the delivery to users. The discrete value AD at the rest position, discrete value AD at the end position and position ratio therebetween are examples of the pieces of basic data. A calibration ratio is defined as a ratio between an initial reference discrete value AD and a present reference discrete value AD. The initial reference discrete value AD and present reference discrete value AD are measured in the open state, in which any shutter plate does not interfere with the light, so that the aged deterioration is influential in the calibration ratio. The discrete value AD at the rest position and discrete value AD at the end position are actually measured for each of the black and white keys 1*a*/1*b*, and the position ratio is calculated for each black and white key 1*a*/1*b*. In the following description, Rc, Ec and $\alpha$ stand for the discrete value AD at the rest position, discrete value AD at the end position and position ratio, respectively.

Using the basic data, the data processing unit 27 automatically calibrates the hammer sensors 26. The method for the calibration is disclosed in Japanese Patent Application laid-open No. 2000-155579. If the present reference discrete value is found to be reduced from the initial reference discrete value, the discrete values Rc and Ec are presumed to be also reduced, and the initial discrete value Rc is presumable through the multiplication between the present discrete value Rc and the calibration ratio. The initial discrete value Ec is presumed through the multiplication between the presumed discrete value Rc and the position ratio.

The discrete values Rc and Ec define the hammer stroke, and reference discrete values at other reference points on the hammer trajectories are calculated on the basis of the discrete values Rc and Ec. The data processing unit 27 discriminates the hammer motion with reference to the discrete values Rc/Ec and reference discrete values in the recording. For example, the motion analyzer 28 acknowledges the arrival at the end position, i.e., the strike on the string 4 by comparing the discrete value AD with the discrete value Ec. Thus, the manufacture prepares the basic data, and the data processing unit 27 determines the thresholds on the basis of the basic data for discriminating the hammer motion.

As described hereinbefore, the discrete value Ec is determined through the multiplication between the present discrete value Rc and the position ratio $\alpha$. However, the position ratio $\alpha$ is variable. The mechanical component parts of the acoustic piano 100 are also under the influence of the aged deterioration so that the relative position among the mechanical component parts tends to be varied for a long service time. A rectification is required for the relative position between the hammers 2 and the hammer sensors 26.

In order to determine the end position exactly through the rectification, the manufacturer measures the amount of deflection of the strings 4 at the strikes with the associated hammers 2, and stores the amount of deflection as pieces of basic data in the electrically erasable and programmable memory devices.

The data processing unit 27 accumulates the series of discrete values AD on the hammer trajectory, and determines the discrete value Ec on the basis of the series of discrete values AD and the pieces of basic data representative of the deflection. Thus, the relative position between the hammers 2 and the hammer sensors 26 is rectified against the aged deterioration on the mechanical component parts of the piano 100.

Description is made on the pieces of basic data representative of the deflection. The hammers 2 reach the end positions over the travel from the rest positions, and the hammer stroke is of the order of 48 millimeters. When the hammers 2 reach the end position, the hammers 2 are assumed to be brought into collision with the strings 4. The strikes on the strings 4 give rise to the deflection of the strings 4. The amount of deflection is dependent on the strength of the impact. In other words, the deflected strings 4 permit the hammers 2 to run over the end positions. If the relation between the deflection and the strength of impact is known, the end position is presumed to be spaced from the turning point by the value of deflection.

Figure 3:
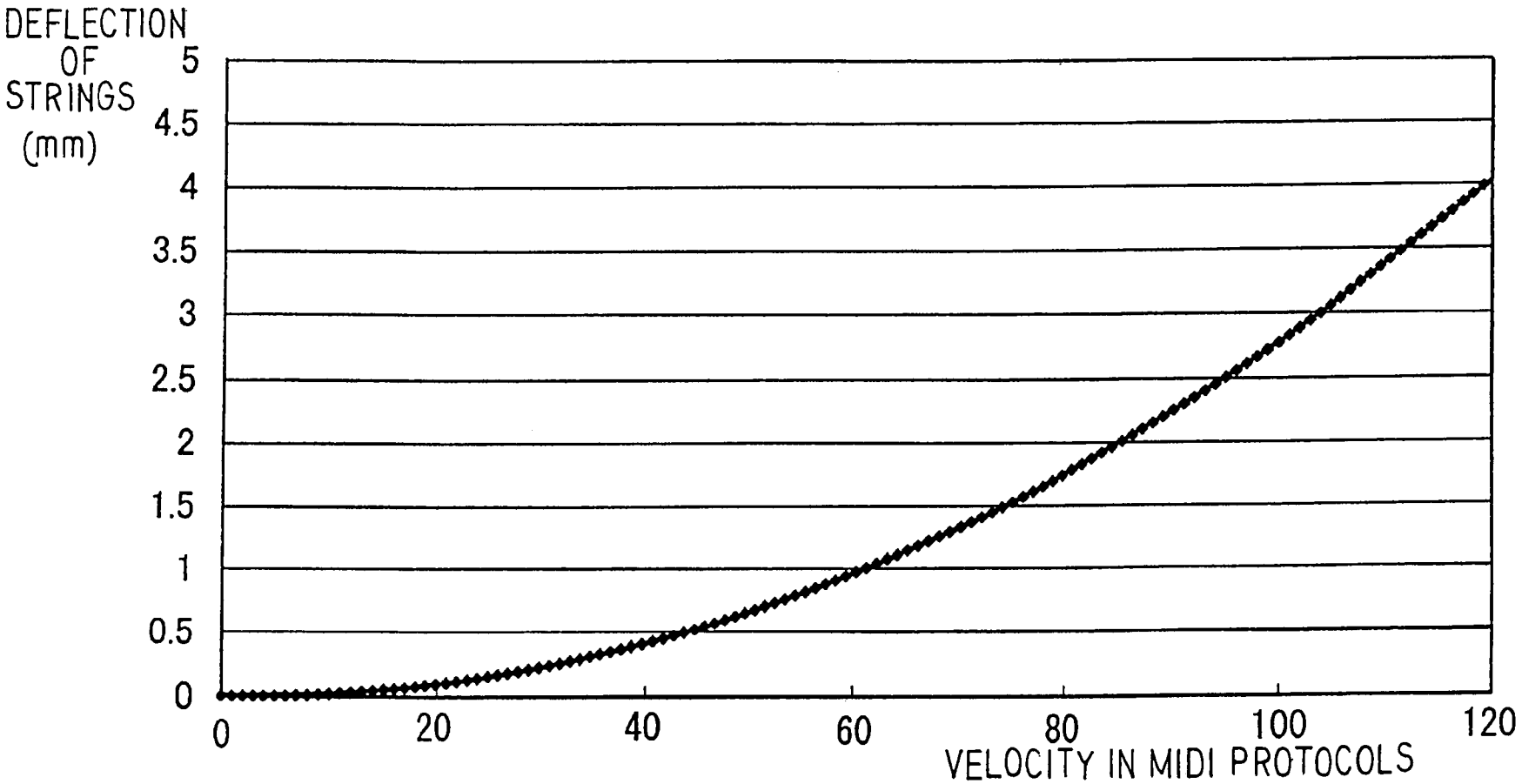
FIG. 3 is a graph showing a relation between the deflection of strings and the hammer velocity.
Figure 4:
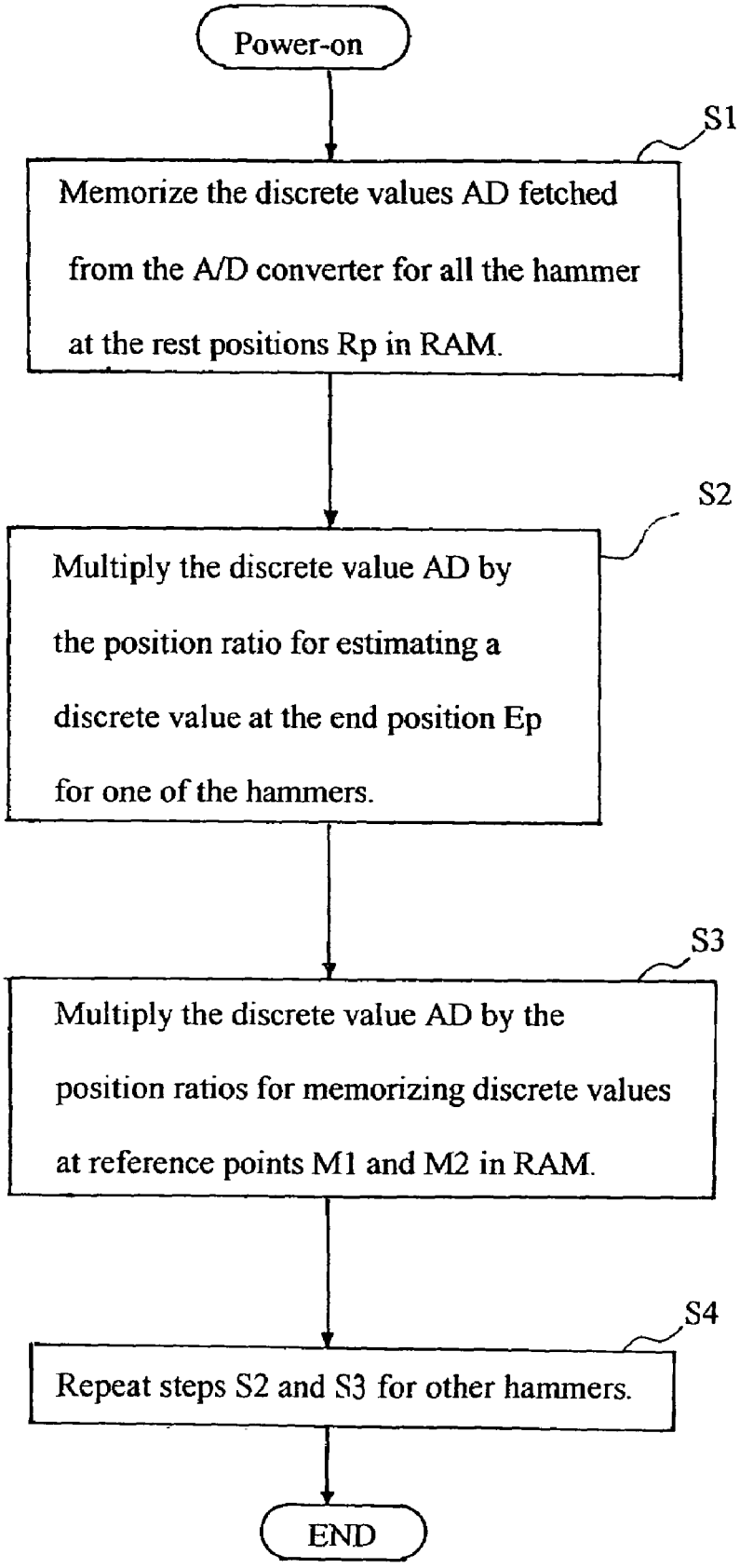
FIG. 4 is a flowchart showing a sequence of jobs executed for calculating thresholds.

FIG. 3 shows a relation between the deflection of strings 4 and the hammer velocity. The hammer velocity is expressed by the value defined in the MIDI protocols. The manufacturer determines the relation through experiments on a master automatic player piano before the delivery to users. In detail, the manufacturer gives pieces of test data representative of the hammer velocity to the preliminary data processor 10 of the master automatic player so that the hammers 2 are brought into collision with the strings 4 at the target hammer velocity. The manufacturer measures the deflection of strings 4, and determines the relation between the hammer velocity and the deflection of strings 4. In this instance, the relation between the deflection of strings 4 and the hammer velocity is shared among all the hammers 2, and is stored in the read only memory 21 as a "deflection table".

In the rectification work, the central processing unit 20 gives rise to the hammer motion at a predetermined value of the hammer velocity, and accumulates a series of discrete values representative of the hammer trajectory.

The central processing unit 20 determines the turning point on the hammer trajectory. Subsequently, the central processing unit 20 accesses the table where the relation between the deflection of strings 4 and the hammer velocity is stored, and reads out the value of deflection at the predetermined value of hammer velocity. The central processing unit 20 adds the value of deflection to the minimum discrete value, which expresses the turning point so as to determine the discrete value Ec expressing the end position.

Since the motion controller 28 analyzes the series of discrete values during the recording, the motion controller 28 can rectify the relative position between the hammers 2 and the hammer sensors 26.

Computer Program

Description is hereinafter made on a part of the main routine program and some subroutine programs, which relate to the calibration, rectification and analysis on the hammers 2. In this instance, two reference positions M1 and M2 are required for the analysis on the hammer motion. The rest position Rp and end position Ep are found at the hammer stroke of zero and hammer stroke of 48 millimeters. The first reference position M1 is defined at 8 millimeters before the end position Ep, and the second reference point M2 is defined at 0.5 millimeter before the end position Ep.

When a user turns on the power-supply switch on the manipulating panel (not shown), the central processing unit 20 starts, and firstly initializes the electric system. Steps 1 to 4 are incorporated in the initialization program.

The central processing unit 20 firstly fetches the discrete values AD, which are representative of the hammers 2 at the respective rest positions Rp, from the interface 24, and memorizes the discrete values ADr in the random access memory 22 as by step S1.

Subsequently, the central processing unit 20 reads out the position ratio $\alpha$ between the rest position Rp and the end position Ep, and multiplies the discrete value ADr by the position ratio $\alpha$ so as to estimate the discrete value ADe at the end position Ep for one of the hammers 2 as by step S2.

Subsequently, the central processing unit 20 reads out other position ratios for the reference positions M1 and M2 from the read only memory 22. The central processing unit 20 multiplies the discrete value ADr at the rest position Rp by the position ratios so as to estimate discrete values ADm1 and ADm2 at the reference positions M1/M2. The central processing unit 20 memorizes the discrete values ADm1/ADm2 at the reference positions M1/M2 in the random access memory 22 as by step S3.

Finally, the central processing unit 20 sequentially reads out the discrete values ADr from the random access memory 22, and repeats steps S2 and S3 for each of the other hammers 2 as by step S4 for storing the discrete values ADr, ADe, ADm1 and ADm2 in the random access memory 22. Thus, the discrete values ADr and ADe are rewritten during the initialization work.

Figure 5:
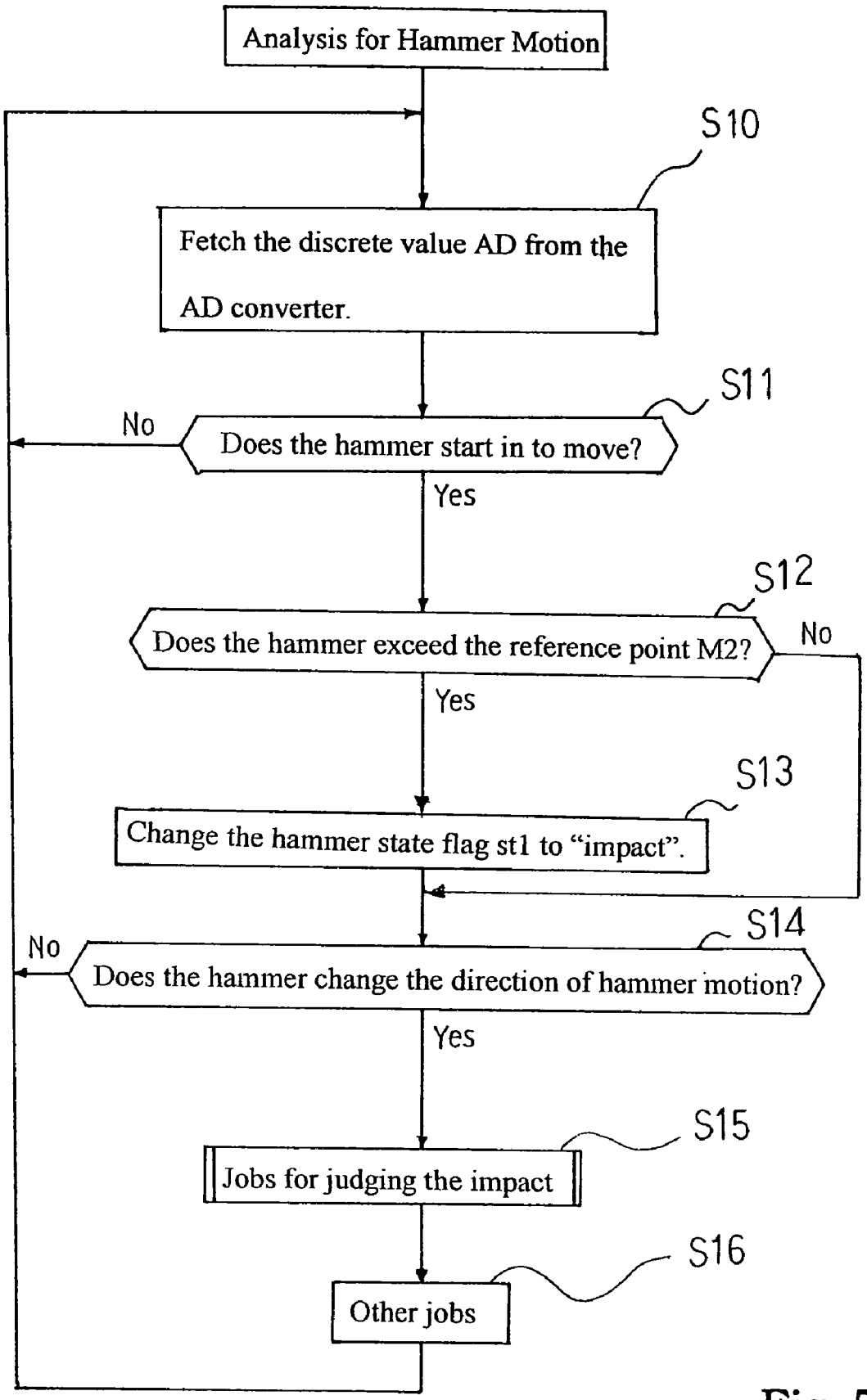
FIG. 5 is a flowchart showing a sequence of jobs executed for an analysis on hammer motion.

The central processing unit 20 makes various decisions on the hammer motion with reference to the discrete values ADr, ADe, ADm1/ADm2 in the analysis on the hammer motion as illustrated in FIG. 5. Although the central processing unit 20 repeats the loop shown in FIG. 5 eighty-eight times, the loop is once described for a presently noticed hammer for the sake of simplicity.

A pianist is assumed to instruct the recording system 500 to record his or her performance. Then, the main routine program branches to a subroutine program for the recording, and the loop for the analysis is carried out for each of the eighty-eight hammers 2 as a part of the subroutine program for the recording.

The central processing unit 20 firstly fetches the discrete value AD indicative of the current hammer position of the presently noticed hammer 2 from the interface 24 as by step S10. The central processing unit 20 checks the internal clock for the time TIME at which the discrete value AD is fetched, and accumulates the discrete value AD and time TIME in a table TBL1 shown in FIG. 6A. Eighty-eight tables are prepared in the random access memory 22, and are respectively assigned to the eighty-eight hammers 2. The table TBL1 shown in FIG. 6A is assumed to the assigned to the presently noticed hammer 2. The table TBL1 contains twenty memory locations, and the twenty pairs of discrete values AD and times TIME are stored in the twenty memory locations, respectively. The new pair of discrete value AD and time TIME is accumulated in the first memory location 1, and the pairs of discrete values AD and times TIME are moved to the next memory locations 2-19, respectively. The oldest pair is pushed out from the table TBL1. Thus, the newest twenty pairs of discrete values AD and times TIME are accumulated in the table TBL1.

Subsequently, the central processing unit 20 checks the table TBL1 to see whether or not the hammer 2 has started to travel on the hammer trajectory as by step S11. In this instance, the central processing unit 20 compares the newest discrete values AD with the discrete value ADr in order to answer the question at step S11. If the central processing unit 20 finds the hammer 2 at the rest position, the answer is given negative "No", and the central processing unit 20 returns to steps S10. Thus, the central processing unit 20 reiterates the loop consisting of steps S10 and S11 so as to find the hammer or hammers 2 already left the rest position Rp.

The pianist is assumed to depress the black or white key 1*a*/1*b* linked with the presently noticed hammer 2. The answer at step S11 is given affirmative "Yes". With the positive answer "Yes", the central processing unit 20 proceeds to step S12, and compares the newest discrete value AD with the discrete value ADm2 to see whether or not the hammer 2 has passed the second reference position M2 as by step S12. As described hereinbefore, the second reference points M2 is spaced from the end position Ep by only 0.5 millimeter. While the answer at step S12 is given negative "No", the hammer 2 is still on the way to the second reference position M2, and the central processing unit 20 proceeds to step S14 without any execution at step S13. For this reason, the central processing unit 20 keeps a hammer state flag st1 in "non-impact state".

On the other hand, when the hammer 2 reaches or exceeds the second reference point M2, the answer at step S112 is given affirmative "Yes", and the hammer 2 is found to be immediately before the impact on the string 4. In other words, it is possible to presume that the hammer 2 will soon be brought into collision with the string 4. Thus, the second reference position M2 serves as a threshold for the presumption, and makes it possible easily to discriminate the hammer 2 immediately before the impact on the string 4.

With the positive answer "Yes" at step S12, the central processing unit 20 proceeds to step S13, and changes the hammer state flag st1 from "non-impact state" to "impact state". While the hammer 2 is traveling on the hammer trajectory between the rest position and the second reference position M2, the hammer state flag st1 is indicative of the non-impact state.

Subsequently, the central processing unit 20 checks the table TBL1 to see whether or not the hammer 2 changes the direction of the hammer motion as by step S14. As described hereinbefore, a series of discrete values AD is stored in the table TBL1. If the discrete values AD are simply decreased or increased toward the latest discrete value AD, the central processing unit 20 decides that the hammer 2 is advancing toward the end position Ep or leaving the end position Ep, and the answer at step S14 is given negative "No". Then, the central processing unit 20 returns to step S10, and reiterates the loop consisting of steps S10 to S14 until the answer is changed to the affirmative.

If the series of discrete values AD are peaked at a certain fetching time TIME, the central processing unit 20 decides that the hammer 2 has changed the direction of hammer motion, and the answer at step S14 is changed to the positive answer "Yes". The central processing unit 20 assumes that the hammer 2 rebounded on the string 4 at the certain fetching time TIME, and prepares a table TBL2 shown in FIG. 6B.

The table TBL2 has eleven memory locations, which are assigned to the five pairs of discrete values AD(−5) to AD(−1) and times t(−5) to t(−1), the pair of discrete value AD(0) and time t(0) at the turning point and the five pairs of discrete values AD(1) to AD(5) and times t(1) to t(5). The hammer velocity V(−4) to V(5) and hammer acceleration a(−4) to a(4) are calculated on the basis of the pairs of discrete values AD and times t, and are written in the eleven memory locations, respectively. The hammer motion is assumed to be uniform, and the central processing unit 20 divides the increment in stroke between each point and the previous point by the increment of time therebetween. The central processing unit 20 determines the acceleration through the differentiation on the calculated hammer velocity. There are various calculation methods for the velocity and acceleration. Any calculation method is available for the hammers 2.

The table TBL2 may be prepared at step S1 together with the table TBL1. The velocity and acceleration may be calculated at step S10. If the velocity is calculated at step S10, it is possible to determine the direction of hammer motion on the basis of the velocity in the table TBL2.

Upon completion of the jobs at step S14, the central processing unit 20 proceeds to step S15. The jobs at step S15 will be hereinafter described with reference to FIG. 7.

Upon completion of the jobs at step S115, the central processing unit 20 proceeds to step S16, and achieves other jobs carried out on the basis of the results of the analysis. One of the important jobs is to produce the note-on event codes and note-off event codes. Pieces of music data such as the depressed/released key number Kni and hammer velocity are memorized in the note-on event/note-off event as defined in the MIDI protocols.

When the music data codes are produced, the central processing unit 20 stores the music data codes in the working memory 22, and returns to step S10. Thus, the central processing unit 20 reiterates the loop consisting of steps S10 to S16 until the pianist instructs the recording system 500 to complete the recording.

Figure 7:
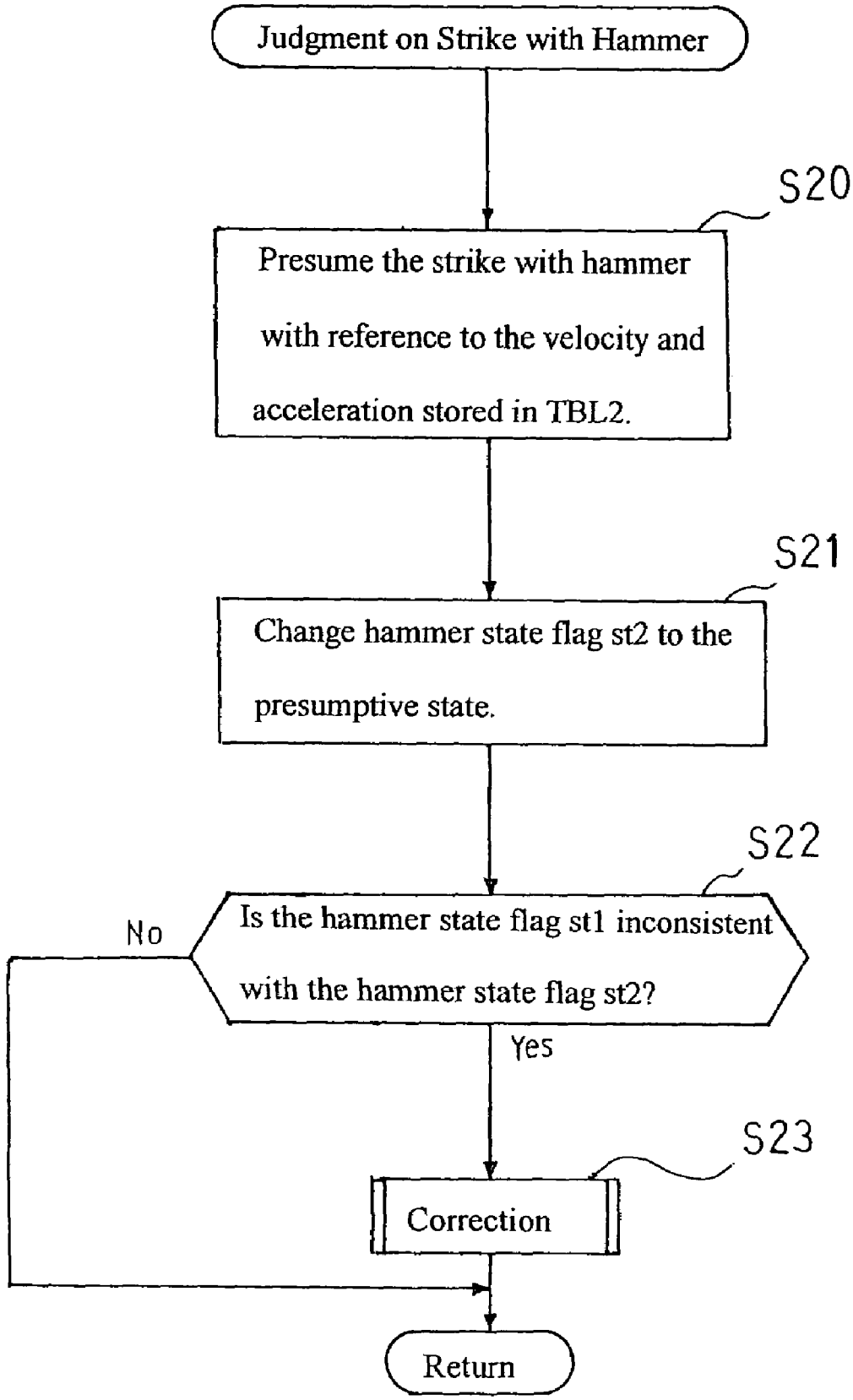
FIG. 7 is a flowchart showing a sequence of jobs executed for judging the hammer motion.

Turning to FIG. 7, the central processing unit 20 firstly accesses the table TBL2, and checks the velocity and acceleration to see whether or not the hammer 2 changes the direction of motion as by step S20. In detail, the central processing unit 20 analyzes the velocity and acceleration from t(−5) to t(0), and determines the hammer behavior toward the string 4. Subsequently, the central processing unit 20 analyzes the velocity and acceleration from t(0) to t(5), and determines the hammer behavior after the rebound. The central processing unit 20 investigates the hammer behavior to see whether or not the hammer 2 fulfills one of the following conditions.

Condition 1:

In case where one of the values of velocity v(0), v(−1) and v(−2) is greater than a critical velocity, which is, by way of example, 0.3 m/s, the central processing unit 20 acknowledges that the hammer 2 is fast enough to strike the string 4, and presumes that the hammer 2 is surely brought into collision with the string 4.

Condition 2:

In case where the absolute value |a(0)| is the greatest in the group of the absolute values |a(−3)|, |a(−2)|, |a(−1)|, |a(0)|, |a(1)|, |a(2)| and |a(3)|, the central processing unit 20 presumes that the hammer 2 is possibly brought into collision with the string 4.

Condition 3:

In case where the central processing unit 20 finds another absolute value to be greater than the absolute value |a(0)|, i.e., the hammer 2 does not fulfill the condition 2, and/or in case where the velocity v(0), which is determined through the quadratic curve approximation, is nearly equal to zero, the central processing unit 20 presumes that there is a high possibility not to strike the string 4 with the hammer 2.

Upon completion of the presumption, the central processing unit 20 changes a hammer state flag st2 to the presumptive state depending upon the condition fulfilled by the hammer 2 as by step S21. Thus, the hammer state flag st2 expresses the positive presumptive state corresponding to the condition 1 or condition 2 or negative presumptive state corresponding to the condition 3. Otherwise, the hammer state flag st2 may express the presumptive state that the hammer 2 is admitted to be surely brought into collision with the string 4, presumptive state that the hammer may be brought into collision with the string 4 or presumptive state that the hammer may not be brought into collision with the string 4.

Subsequently, the central processing unit 20 compares the hammer state flag st1 with the hammer state flag st2 to see whether or not the inconsistency takes place between the presumptions as by step S22. If the presumptive state st1 is consistent with the presumptive state st2, the answer at step S22 is given negative "No", and the central processing unit 20 returns to the loop consisting of steps S10 to S16. When the inconsistency is found, the answer at step S22 is given affirmative "Yes", and the central processing unit 20 proceeds to step S23, and carries out jobs for rectification shown in FIG. 8.

Figure 8:
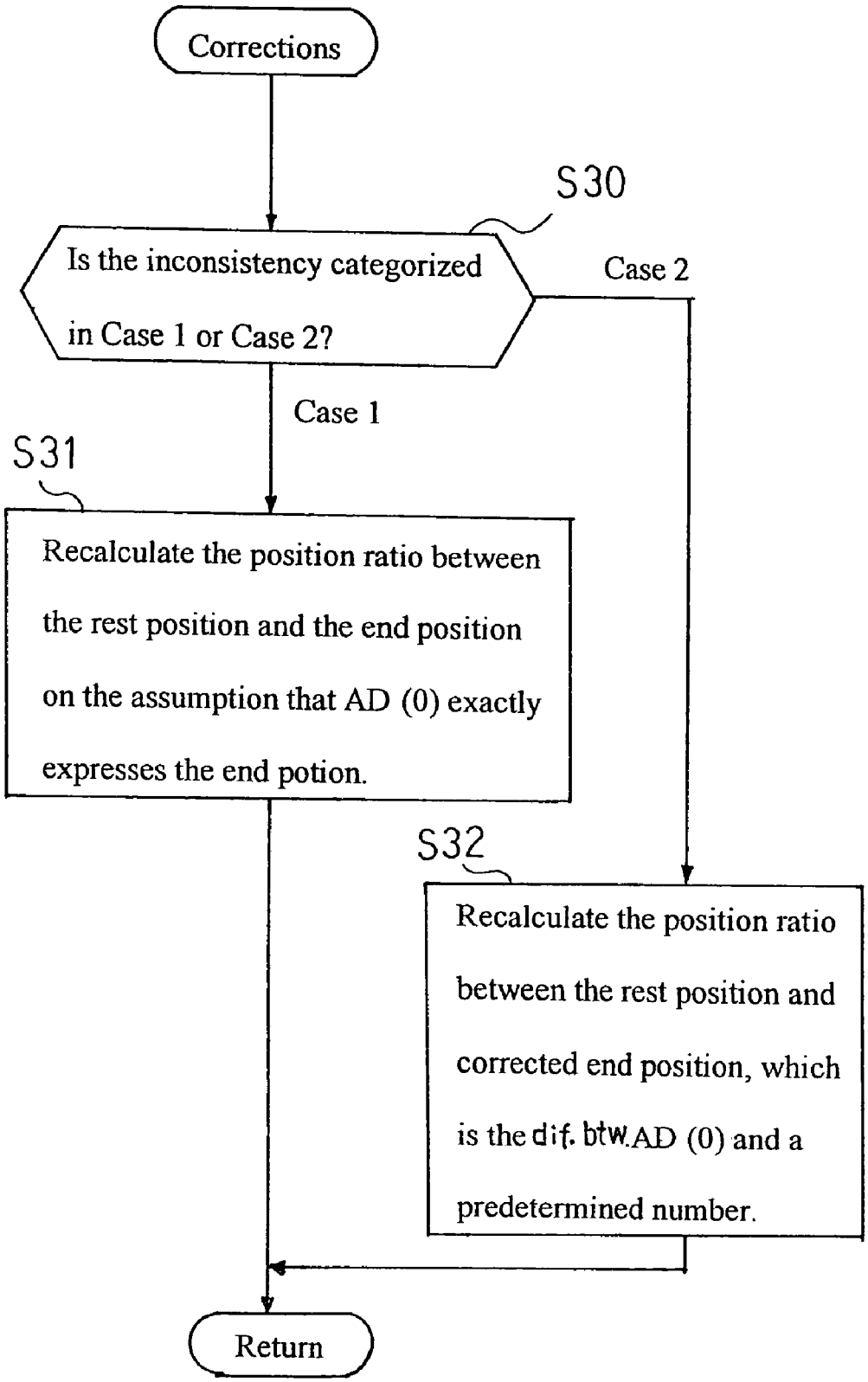
FIG. 8 is a flowchart showing a sequence of jobs executed for a rectification.

Upon completion of the jobs shown in FIG. 8, the central processing unit 20 returns to the loop consisting of steps S10 to S16.

Turning to FIG. 8 of the drawings, the central processing unit 20 examines the inconsistency to see which case the inconsistency is categorized in as by step S30.

Case 1: The hammer state flag st1 expresses the "non-impact state", and the other hammer state flag st2 expresses the positive presumptive state.

Case 2: The hammer state flag st1 expresses the "impact state", and the other hammer state flag st2 expresses the negative presumptive state.

When the central processing unit 20 categorizes the inconsistency in the case 1, the central processing unit 20 proceeds to step S31, and recalculates the position ratio between the rest position Rp and the end position Ep. In detail, the positive presumptive state, which is memorized in the hammer state flag st2, is more reliable than the presumption memorized in the other hammer state flag st1, because the presumptive state is based on the actual hammer motion. The central processing unit 20 presumes that the discrete value ADe at the end position Ep is less than a true value indicative of the end position Ep. The small discrete value ADe makes the reference point M2 farther from the rest position R. Since the discrete value ADr at the rest position Rp is determined on the basis of the discrete value AD fetched from the output node of the analog-to-digital converter 24*b*, the discrete value ADr correctly indicates the rest position Rp, and the position ratio α between the rest position Rp and the end position Ep is to be doubtful. For this reason, the central processing unit 20 recalculates the ratio α between the rest position Rp and the end position Ep. The discrete value AD(0) correctly indicates the end position Ep. The central processing unit 20 determines the ratio α between the discrete value AD(0) and the discrete value ADr, and memorizes the correct position ratio in the electrically erasable and programmable memory 21. The discrete values ADm1 and ADm2 are also recalculated on the basis of the discrete value ADr and the new discrete value ADe.

When the central processing unit 20 categorizes the inconsistency in Case 2, the central processing unit 20 recalculates the position ratio α as by step S32. In detail, the negative presumptive state is also more reliable than the presumption memorized in the hammer state flag st1. The reason why the central processing unit 20 presumes the impact state is that the discrete value ADe is greater than the true value at the end position Ep, and recalculates the position ratio α between the rest position Rp and the end position Ep. The true value at the end position E is possibly less than the discrete value AD(0) so that the central processing unit 20 adds a predetermined value "x" to the discrete value AD(0). The central processing unit assumes the difference AD(0)−x indicates the end position Ep, and determines the ratio α between the discrete value ADr and the difference AD(0)−x. The ratio between the discrete value ADr and the difference AD(0)−x is memorized in the electrically erasable and programmable memory 21 as the position ratio α between the rest position Rp and the end position Ep. Thereafter, the central processing unit 20 recalculates the discrete values ADm1/ADm2 at the reference positions M1/M2. Even if the predetermined value x is too large, the inconsistency takes place, again, and the inconsistency is categorized in Case 1 in the next execution. Upon completion of the job at step S31 or S32, the central processing unit 20 returns to the job sequence shown in FIG. 7.

As will be understood from the foregoing description, the central processing unit 20 twice presumes the strike on the string 4 through the different procedures, and compares the results of the presumptions with one another to see whether or not the discrete value ADe correctly indicates the end position Ep. Even if the relative position between the hammers 2 and the hammer sensors 26 is varied due to the aged deterioration on the mechanical component parts, the central processing unit 20 rectifies the hammer sensors 26 by changing the discrete value ADe. The rectification is carried out during the jobs for the recording. In other words, the thresholds are adjusted to appropriate values ADe and ADm1/ADm2 in the real time fashion so that the motion analyzer 28 exactly analyzes the hammer motion with reference to the thresholds.

Second Embodiment

Figure 9:
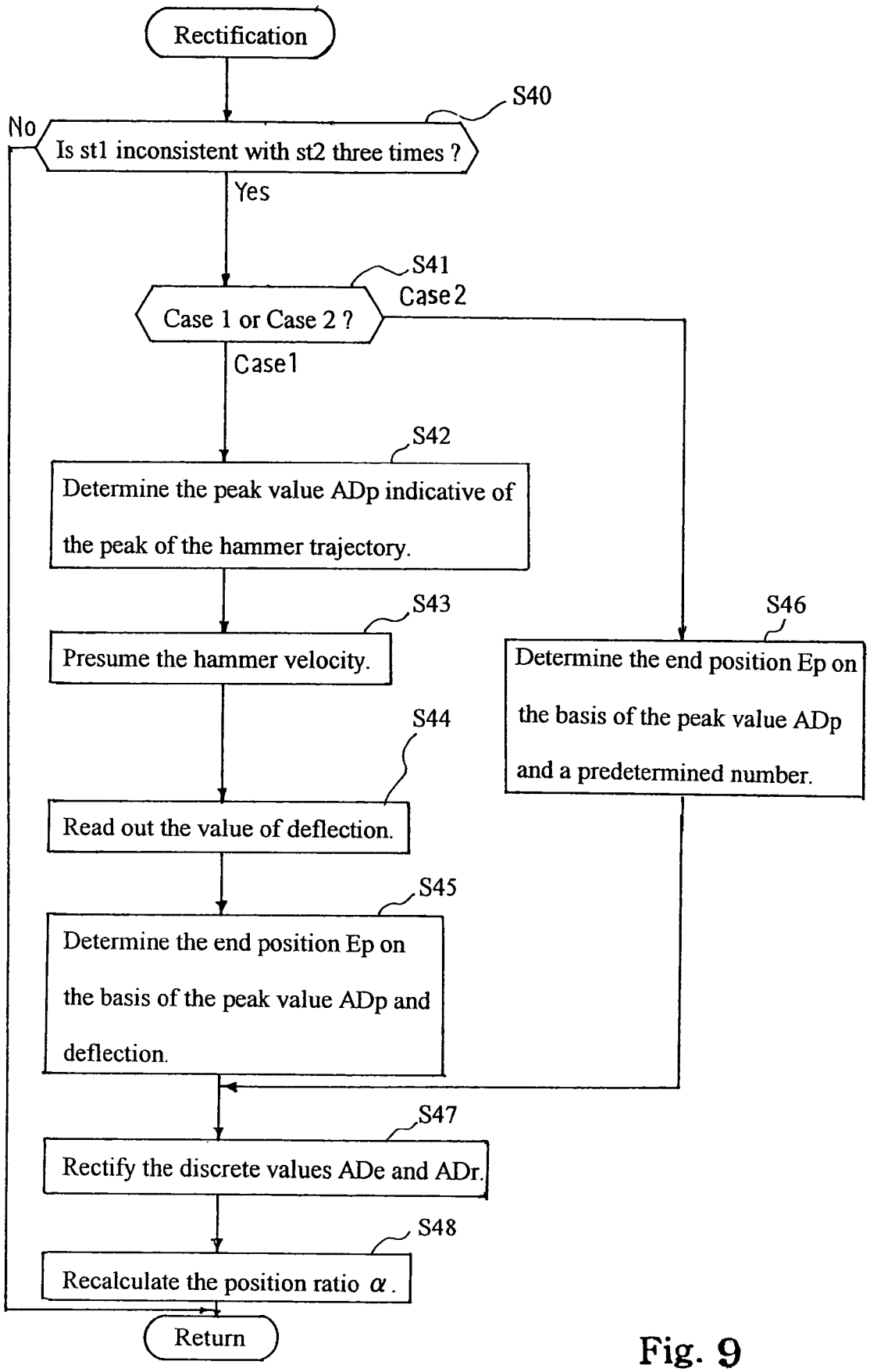
FIG. 9 is a flowchart showing a sequence of jobs employed in another automatic player for the rectification.

FIG. 9 shows another sequence of jobs for the rectification. Although the sequence of jobs shown in FIG. 8 is replaced with the sequence of jobs shown in FIG. 9, the acoustic piano 100, electric system and the other part of the computer program are similar to those of the first embodiment. For this reason, description is focused on the job sequence shown in FIG. 9. The mechanical components and system components are labeled with references designating the corresponding components of the first embodiment without detailed description.

In this instance, a counter is defined in the random access memory 22. When the central processing unit 20 finds the inconsistency between the presumptive state st1 and the presumptive state st2 at step S22, the central processing unit 20 increments the counter by one, and proceeds to step S40.

The central processing unit 20 checks the counter to see whether or not the inconsistency is repeated three times at step S40. If the counter indicates 1 or 2, the answer at step S40 is given negative "No". With the negative answer "No", the central processing unit 20 returns the sequence of jobs shown in FIG. 5, and proceeds to step S16.

When the counter indicates 3, the answer at step S40 is given affirmative "Yes", and the central processing unit 20 compares the presumptive state st1 with the presumptive state st2 to see whether the inconsistency is categorized in Case 1 or Case 2 as by step S41. The two cases have been already described in conjunction with the sequence of jobs shown in FIG. 8, and the description is not repeated.

When the central processing unit 20 determines that the inconsistency is categorized in Case 1, the central processing unit 20 analyzes the series of discrete values stored in the table TBL 2, and determines the peak of the hammer trajectory as by step S42. The peak is found at time t(0), and ADp is indicative of the discrete value AD at the peak.

The central processing unit 20 further reads out the hammer velocity v(0) from the table TBL 2 as by step S43, and accesses the deflection table so as to read out the amount of deflection at the hammer velocity v(0) as by S44.

Subsequently, the central processing unit 20 determines the discrete value ADe indicative of the true end position Ep on the basis of the discrete value ADp and a discrete value equivalent to the read-out deflection value as by step S45. In this instance, the discrete value equivalent to the deflection is added to the discrete value ADp. When the hammer 2 is brought into collision with the string 4, the string 4 is deflected, and the hammer 2 runs over the end position Ep.

Even though the hammers 2 are varied in dimensions due to the aged deterioration, the aged deterioration is less influential in the velocity-to-deflection characteristics of the strings 4. When the relative position between the hammers 2 and the hammer sensors 26 is varied due to the aged deterioration on the hammers 2, the discrete value ADp is also varied. However, the strings 4 keep the velocity-to-deflection characteristics. For this reason, the central processing unit 20 determines the discrete value ADe indicative of the true end position by adding the discrete value equivalent to the amount of deflection to the discrete value ADp.

If, on the other hand, the inconsistency is categorized in Case 2 , the true value at the end position E is possibly less than the discrete value AD(0) so that the central processing unit 20 adds a predetermined value "x" to the discrete value AD(0) on the assumption that the difference AD(0)−x indicates the end position Epas by step S46.

Thus, the central processing unit 20 determines the discrete value ADe indicative of the true end position Ep at either steps S42 to S45 or step S46. In either case, when the discrete value ADe is changed, the central processing unit 20 rewrites the discrete values ADr and ADe as by step S47, and recalculates the position ratio α as by step S48.

As will be understood from the foregoing description, even if the relative position between the sensor and the objective component part, i.e., hammer 2 is varied, the datum points such as, for example, the end position Ep and reference positions M1/M2 are rectified on the basis of the actual reference trajectory and the deflection of another component part, which interacts with the objective component part. As a result, the motion analyzer 28 exactly presumes the motion of the objective component part.

In case where the pieces of music data representative of a performance are produced through the analysis on the motion of the objective component parts, the performance is recorded at a high fidelity. In case where the objective component parts are controlled in the playback through the servo control loop, which contains the sensors, the servo control loop makes the objective component parts exactly travel on the reference trajectories so that the musical instrument reenacts the performance at the high fidelity.

Although particular embodiments of the present invention have been shown and described, it will be apparent to those skilled in the art that various changes and modifications may be made without departing from the spirit and scope of the present invention.

The MIDI protocols do not set any limit to the technical scope of the present invention. Any protocols are available for the music data in so far as the data codes can express the pieces of music data.

The servo control loop may include the hammer sensors 26 instead of the built-in plunger sensors 5*c*. In this instance, the current key positions are presumed on the basis of the current hammer positions, and the rectification may be carried out during the playback.

Plural deflection table may be prepared and stored in the read only memory 21 by the manufacturer. In this instance, the central processing unit 20 selectively accesses the deflection tables depending upon the note number or key number Kni.

The grand piano does not set any limit to the technical scope of the present invention. An automatic player piano may be fabricated on the basis of an upright piano. The present invention may appertain to a mute piano. The mute piano includes an acoustic piano, a hammer stopper and an electronic tone generating system. The hammer stopper is changed between a free position and a blocking position. While the hammer stopper is staying at the free position, a pianist plays a piece of music on the acoustic piano. When the hammer stopper is changed to the blocking position, the hammer stopper is moved into the trajectories of the hammers. While the player is fingering on the acoustic piano, the hammers rebound on the hammer stopper before striking the strings, and the electronic tone generating system produces electronic tones instead of the acoustic piano tones. The electronic tone generating system includes the hammer sensors, and the hammer sensors monitor the associated hammers. The motion analyzer determines the hammer motion on the basis of the pieces of hammer data supplied from the hammer sensors. The hammer sensors are rectified so as to prevent the hammer sensors from the aged deterioration on the hammers.

The present invention may be applied to another sort of musical instrument such as, for example, a celesta.

The deflection table dose not set any limit on the technical scope of the present invention. The amount of deflection may be expressed by an equation. In this instance, the equation is stored in the read only memory, and the motion analyzer calculates the amount of deflection by using the equation. Otherwise, the pieces of deflection data may be reduced, and the central processing unit determines the amount of deflection through the interpolation.

The manufacturer may determine the initial discrete value ADe through the analysis on the actual hammer motion and the deflection table.

The optical transducer does not set any limit to the technical scope of the present invention. A magnetic sensor, which is constituted by a piece of permanent magnet and a coil, may be installed in the acoustic piano 100 for producing a hammer velocity signal. Otherwise, a semiconductor strain sensor may produce a hammer acceleration signal. A weight and beams, which are connected to the beams at the leading ends thereof, are formed on a semiconductor chip, and the Wheatstone bridge circuit is formed on the beams. The force is proportional to the acceleration so that the hammer acceleration signal representative of the acceleration is output from the Wheatstone bridge circuit.

The present invention may be applied to key sensors, which monitor the key motion so as to rectify the end positions of the keys. In this instance, the deformation of front pin punchings may be taken into account.

In the embodiments, the rectification is achieved by the computer program running on the central processing unit 20. The function of the computer program may be accomplished by function modules implemented by logic gates.

In the above-described embodiments, the end position Ep serves as the datum point to be rectified. However, any position on the hammer trajectory can serve as the datum point. For example, the reference points may be directly rectified.

The component parts of the embodiments are correlated with claim languages as follows. The black/white key 1*a*/1*b*, action unit 3, hammer 2 and string 4 as a whole constitute each "tone generating linkwork", and the hammer 2 and string 4 are respectively corresponding to "a component part" and "another component part". The hammer sensors 26 serve as "plural sensors", and the hammer position signals Vh corresponding to "signals". The discrete values AD serve as each series of "pieces of motion data", and the hammer trajectories are corresponding to "trajectories".

The data processing unit 27 and computer program as a whole constitute a "data processing unit". The central processing unit 20 and instructions for the jobs at steps S10, S11 and S20 as a whole constitute "an analyzer". The points at which the hammers 2 change the direction of motion are corresponding to "unique points", and the discrete values AD(0) are corresponding to "current values". The central processing unit 20 and instructions for the jobs at steps S12, S13, S21 and S22 as a whole constitute a "judge". The discrete value ADe stored in the electrically erasable and programmable memory serves as a "previous value". The central processing unit 20 and instructions for the jobs at steps S30, S31 and S32 as a whole constitute a "rectifier".

The solenoid-operated key actuators 5 serve as "actuator", and the preliminary data processor 10, motion controller 11 and servo controller 12 as a whole constitute an "electronic controller".

What is claimed is:

1. A musical instrument for producing tones, comprising:

plural tone generating linkwork selectively actuated for specifying the tones to be produced, each of said plural tone generating linkworks having a hammer and string, which is deflected when said hammer is brought into collision with said string for producing the tone; and a music data producer including plural sensors monitoring said hammers and producing signals representative of plural series of pieces of motion data expressing motion of the associated hammers on respective trajectories, a data processing unit connected to said plural sensors and having an analyzer analyzing said plural series of pieces of motion data so as to determine current values indicative of unique points on said trajectories, a judge determining whether or not said hammers reach said unique point at previous values and a rectifier adding a value indicative of the amount of deflection to said current value so as to determine true values expressing said unique points on the basis of said current values when said judge makes the negative decision and storing said true values as said previous values in a memory.

2. The musical instrument as set forth in claim 1, in which said amount of deflection is varied together with velocity of said hammer, and a relation between said amount of deflection and said velocity is stored in said memory incorporated in said data processing unit.

3. The musical instrument as set forth in claim 2, in which said relation is stored in said memory in the form of table so that said rectifier reads out said amount of deflection by using said velocity determined on the basis of said plural series of pieces of motion data.

4. The musical instrument as set forth in claim 1, in which said plural tone generating linkworks are incorporated in a keyboard musical instrument so as to permit a player to perform a piece of music on a keyboard, keys of which are depressed for driving said hammers.

5. The musical instrument as set forth in claim 4, in which said player is a human being.

6. The musical instrument as set forth in claim 4, in which said player is implemented by actuators and an electronic controller, and said electronic controller selectively actuates said actuators respectively associated with said plural tone generating linkworks.

7. The musical instrument as set forth in claim 1, in which said plural tone generating linkworks are incorporated in an acoustic piano.

8. The musical instrument as set forth in claim 7, in which said plural series of motion data are indicative of a physical quantity of said hammers on said trajectories.

9. The musical instrument as set forth in claim 8, in which said physical quantity is varied between negative values and positive values with respect to said unique points so that said analyzer determines said unique points on the basis of said physical quantity.

10. The musical instrument as set forth in claim 9, in which said hammers change the direction of motion at turning points on said trajectories due to collision with said strings, and said turning points are spaced from said unique points by the amount of deflection of said strings.

11. The musical instrument as set forth in claim 10, in which said rectifier determines said true values by adding values equivalent to said amount of deflection of the associated strings to said current values.

12. The musical instrument as set forth in claim 11, in which said amount of deflection is varied depending upon velocity of said hammers so that said rectifier determines said velocity on the basis of said plural series of pieces of motion data.

13. A music data producer comprising:

plural sensors monitoring hammers of a musical instrument actuated for specifying tones to be produced, and producing signals representative of plural series of pieces of motion data expressing motion of the associated hammers on respective trajectories, each of said hammers being brought into collision with a string of said musical instrument for producing said tones so that said collision gives rise to deflection of said string; and a data processing unit connected to said plural sensors and having an analyzer analyzing said plural series of pieces of motion data so as to determine current values indicative of unique points on said trajectories, a judge determining whether or not said hammers reach said unique point at previous values, and a rectifier adding a value indicative of the amount of deflection to said current value to as to determine true values expressing said unique points on the basis of said current values when said judge makes the negative decision and storing said true values as said previous values in a memory.

14. The musical data producer as set forth in claim 13, in which said amount of deflection is varied together with velocity of said hammer, and a relation between said amount of deflection and said velocity is stored in said memory incorporated in said data processing unit.

15. The musical instrument as set forth in claim 14, in which said relation is stored in said memory in the form of table so that said rectifier reads out said amount of deflection by using said velocity determined on the basis of said plural series of pieces of motion data.

16. A method for rectifying a value indicative of a unique point on a trajectory of a hammer incorporated in a musical instrument and brought into collision with a string for producing a tone so that said collision gives rise to a deflection of said string, said method comprising the steps of:

a) accumulating pieces of motion data expressing motion of said hammer;

b) finding a unique point on said trajectory;

c) determining a current value indicative of said unique point;

d) judging whether or not said unique point is expressed by a previous value;

e) adding a value indicative of said deflection to said current value so as to determine a true value indicative of said unique point on the basis of said current value when the answer at step d) is given negative;

f) storing said true value as said previous value; and g) repeating said steps a) to d) when the answer at step d) is given affirmative.

17. The method as set forth in claim 16, in which said sub-step e) includes the sub-steps of e-1-1) determining a velocity of said component part immediately before the strike with said component part, and e-1-2) accessing a table where the relation between said amount of deflection and said velocity is defined so as to read out a value of said amount of deflection.

* * * * *